United States Patent [19]

Sudo et al.

[11] Patent Number: 4,909,645

[45] Date of Patent: Mar. 20, 1990

[54] PIVOTABLE SUPPORT ENABLING PAPER INSERTION IN A RECORDING APPARATUS

[75] Inventors: Hiroaki Sudo; Takahiko Manda, both of Mishima, Japan

[73] Assignee: Tokyo Electric Co., Ltd., Tokyo, Japan

[21] Appl. No.: 278,604

[22] Filed: Dec. 1, 1988

[30] Foreign Application Priority Data

Dec. 18, 1987 [JP] Japan ..... 62-320191

[51] Int. Cl.[4] ..... B41J 3/20

[52] U.S. Cl. ..... 400/120; 346/76 PH; 346/145; 358/296; 400/692; 400/613.1

[58] Field of Search ..... 400/120, 691, 692, 693, 400/613, 613.1; 346/76 PH, 145; 358/296

[56] References Cited

U.S. PATENT DOCUMENTS

| | | | |
|---|---|---|---|
| 4,119,974 | 10/1978 | Ondis et al. | 346/145 |
| 4,641,980 | 2/1987 | Matsumoto et al. | 400/120 |
| 4,667,252 | 5/1987 | Nakamura et al. | 358/286 |
| 4,710,810 | 10/1987 | Ikemoto et al. | 358/296 |
| 4,754,337 | 6/1988 | Nohtomi et al. | 358/286 |
| 4,848,945 | 7/1989 | Sone | 400/692 |

FOREIGN PATENT DOCUMENTS

| | | | |
|---|---|---|---|
| 225770 | 12/1983 | Japan | 358/296 |
| 225771 | 12/1983 | Japan | 358/296 |
| 72859 | 4/1984 | Japan | 358/296 |
| 133085 | 7/1984 | Japan | 400/120 |
| 141571 | 6/1986 | Japan | 400/120 |
| 213184 | 9/1986 | Japan | 400/692 |
| 63-134452 | 6/1988 | Japan | 400/120 |

*Primary Examiner*—David A. Wieckling

*Attorney, Agent, or Firm*—Frishauf, Holtz, Goodman & Woodward

[57] ABSTRACT

A recording apparatus comprises a recording unit disposed in a case and including support members for supporting a platen a printing head and a sheet feed guide having an outlet situated near a region between the platen and the printing head an an inlet situated on the side of the rolled recording sheet loaded in the case, the sheet feed guide serving to guide the recording sheet from the inlet toward the outlet, thereby delivering the sheet to the region between the platen and the printing head the support members support the sheet feed guide and is rockable between a recording position, where the inlet of the sheet feed guide faces the recording sheet, and a sheet insertion position, where the inlet of the guide faces on opening of the case. The printing head is disengaged from the platen when the support members are brought to the sheet insertion position. A swing cover is swingably mounted on the case and movable between a closed position, where at least part of the opening is closed to cover the recording unit, and an open position where the opening is opened to expose the recording unit.

17 Claims, 12 Drawing Sheets

PIVOTABLE SUPPORT ENABLING PAPER INSERTION IN A RECORDING APPARATUS

BACKGROUND OF THE INVENTION

1. Field of the Invention

The present invention relates to a recording apparatus used in a printer or a facsimile and designed so that a recording sheet is passed between a platen and a printing head to undergo printing operation.

2. Description of the Related Art

Conventionally, there are printing apparatuses in which a printing head or a platen is mounted on a swing member, such as a keyboard, which can be swung open for the replacement of a rolled recording sheet or other purposes. In the apparatuses of this type, the head and the platen are brought into contact with each other when the swing member is shut down and clamped in position. According to this arrangement, the printing head and the platen are separated when the swing member is swung open, so that the recording sheet can be set without being hindered by the head and the like.

However, in the recording apparatus when the swing member is swung for closing and clamped, the clamping force causes a contact pressure between the recording head and platen, that is a printing pressure, resulting in an irregular printing pressure.

In general, the rolled recording sheet is situated close to a printing region defined by the platen and the printing head, and is set in a manner such that its leading end portion is passed between the platen and the head. In the conventional arrangement, the recording sheet to be set is introduced into the printing region through a fixed inlet. Thus, the sheet cannot be easily inserted by only separating the platen and the printing head in the aforesaid manner.

SUMMARY OF THE INVENTION

A first object of the present invention is to provide a recording apparatus in which a recording sheet can be more easily inserted into a printing region. A second object of the invention is to provide a recording apparatus which facilitates operations for recording sheet setting, including the insertion of the sheet into the printing region.

BRIEF DESCRIPTION OF THE DRAWINGS

FIGS. 1 to 8 show a recording apparatus according to an embodiment of the present invention, applied to a facsimile, wherein FIGS. 1 and 2 are partial sectional views of the apparatus, as taken in different directions, in which a recording sheet is set in position, FIGS. 3 and 4 are partial sectional views of the apparatus, as taken in different directions, in which a recording unit is held in position, FIG. 5 is a perspective view showing the whole apparatus, FIGS. 6 and 7 are perspective views of the apparatus for illustrating the way the recording sheet is set in the apparatus, and FIG. 8 is a side view, partially in section, showing the whole apparatus;

FIGS. 9 to 20 show a recording apparatus according to another embodiment of the invention, wherein FIGS. 9 and 10 are partial sectional views of the apparatus, as taken in different directions, in which a recording sheet is set in position, FIGS. 11 and 12 are partial sectional views of the apparatus, as taken in different directions, in which a recording unit is held in position, FIG. 13 is a partial side view of the apparatus in which some of components shown in FIG. 11 are omitted for simplicity of illustration, FIG. 14 is a partial side view of the apparatus in which some of components shown in FIG. 12 are omitted, and FIGS. 15 to 20 are partial side views of the apparatus successively illustrating the motion of each member accompanying the action of a swing cover; and FIGS. 21 to 23 show an example of a bearing for rotatably supporting a platen on a positioning guide, in which FIG. 21 is a side view of the bearing, FIG. 22 is a perspective view, and FIG. 23 is a sectional view.

DETAILED DESCRIPTION OF THE PREFERRED EMBODIMENTS

Figure 1:
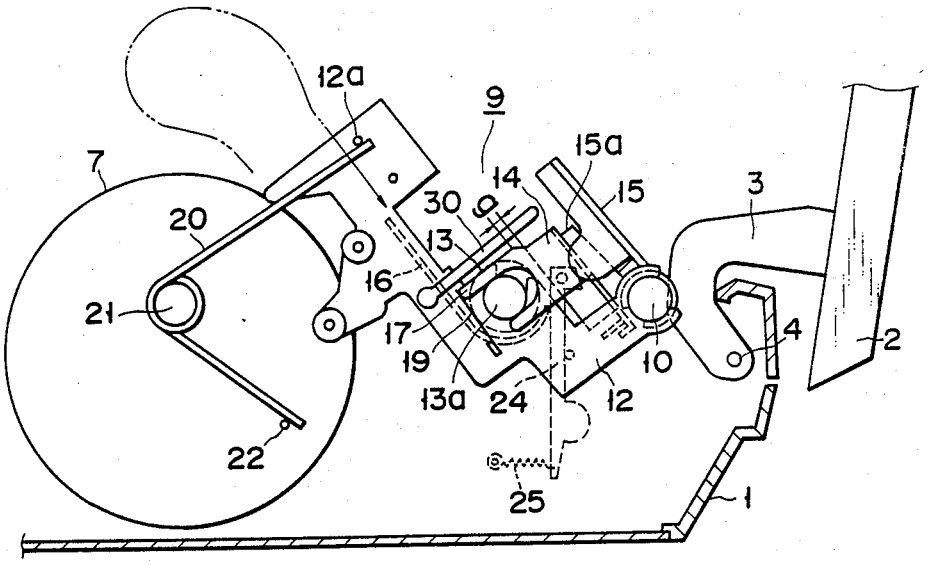

Referring now to FIGS. 1 to 8, a recording apparatus according to an embodiment of the present invention will be described.

In these drawings, numeral 1 designates an open topped body case of a facsimile. The front portion of the opening of body case 1 can be closed by means of swing cover 2 which is mounted on case 1 so as to be forwardly swingable. In this embodiment, cover 2 is provided with a number of control keys so that it serves as a keyboard. In FIGS. 1 to 4, numeral 3 designates a pair of rocking arms which support cover 2 at their first ends, and are spaced from each other in the lateral direction of the cover. The other end of each arm 3 is pivotally supported on the front portion of its corresponding side wall of body case 1 by means of pivot 4. Thus, swing cover 2 is swingably mounted on case 1, as mentioned before. Cover 2 is locked in a closed position in a manner such that retaining pieces 29 protruding from the inside of the cover are caused to engage lock members (not shown) which are attached to case 1. The cover can be released from the locked state by depressing release button 28 shown in FIGS. 5 to 7.

Figure 5:
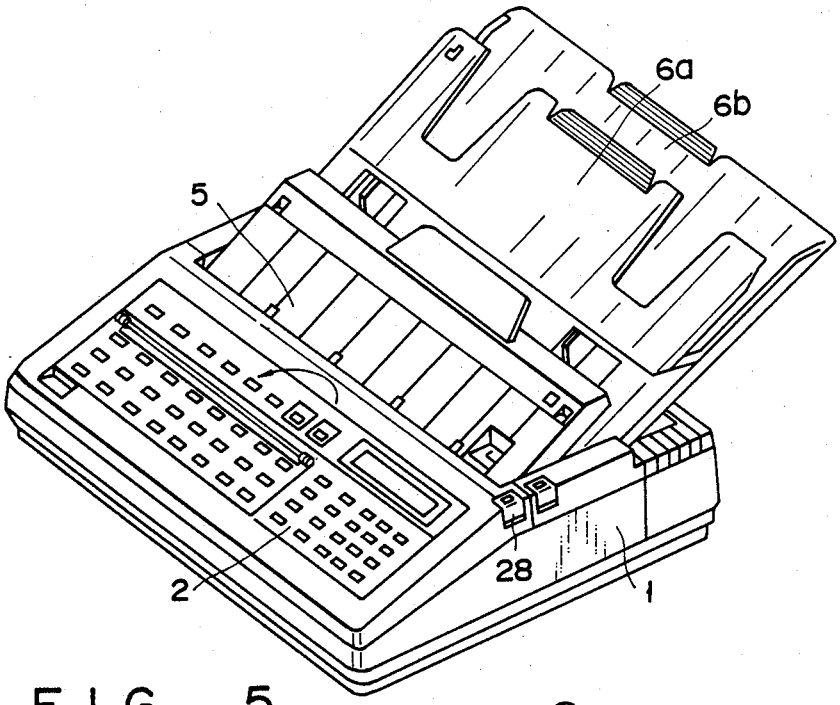
Figure 6:
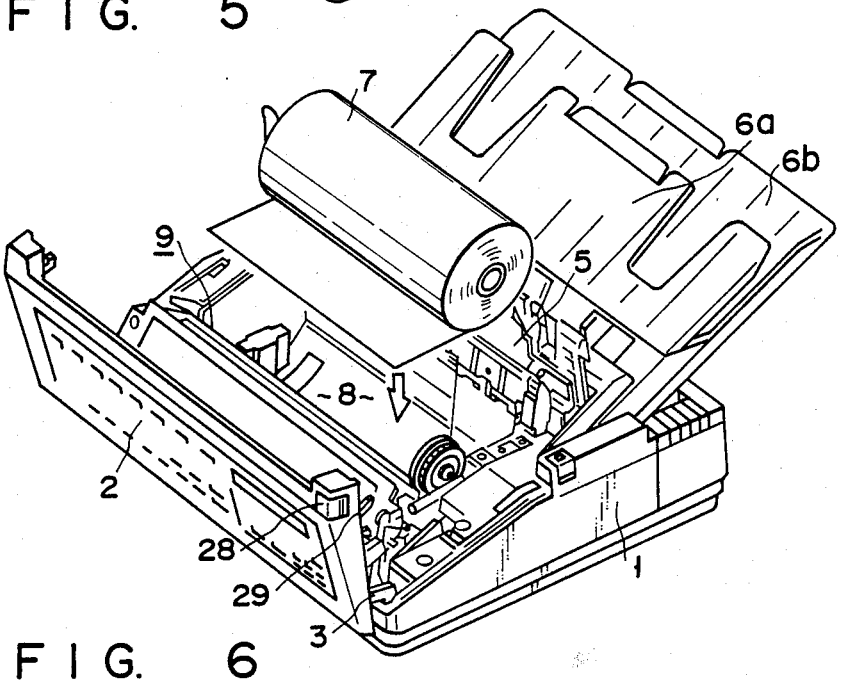
Figure 7:
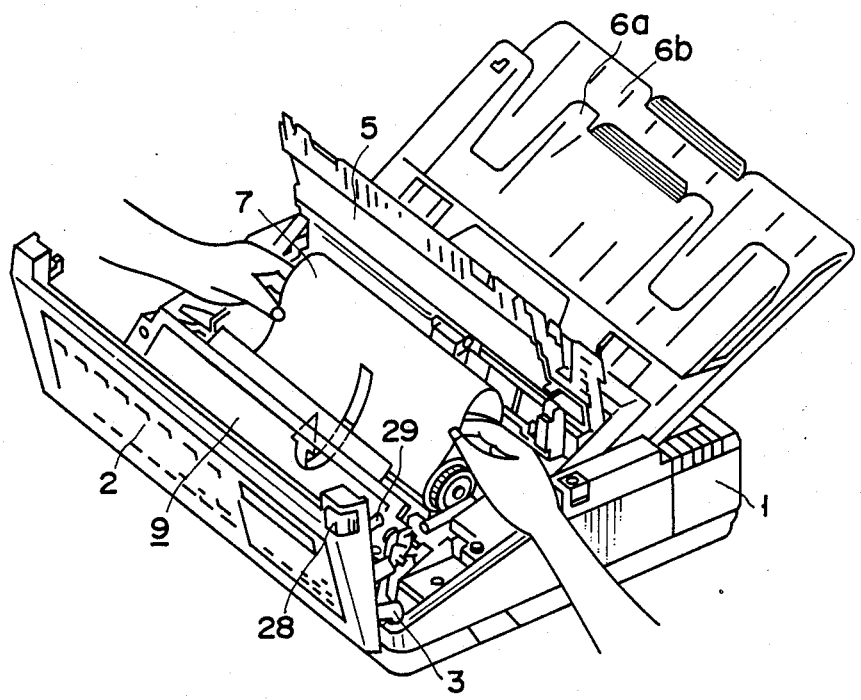

As shown in FIGS. 5 to 7, body case 1 is provided with slanting sheet tray 5 on the rear side of swing cover 2. A pair of slanting document trays **6*a* and 6*b* are provided on the rear side of tray 5. Sheet tray 5 is located so that its slanting lower end is continuous with an outlet of a recording apparatus, which will be mentioned later. As shown in FIG. 7, the rear end of tray 5 is mounted on case 1 so that tray 5** can rearwardly swing open.

Figure 8:
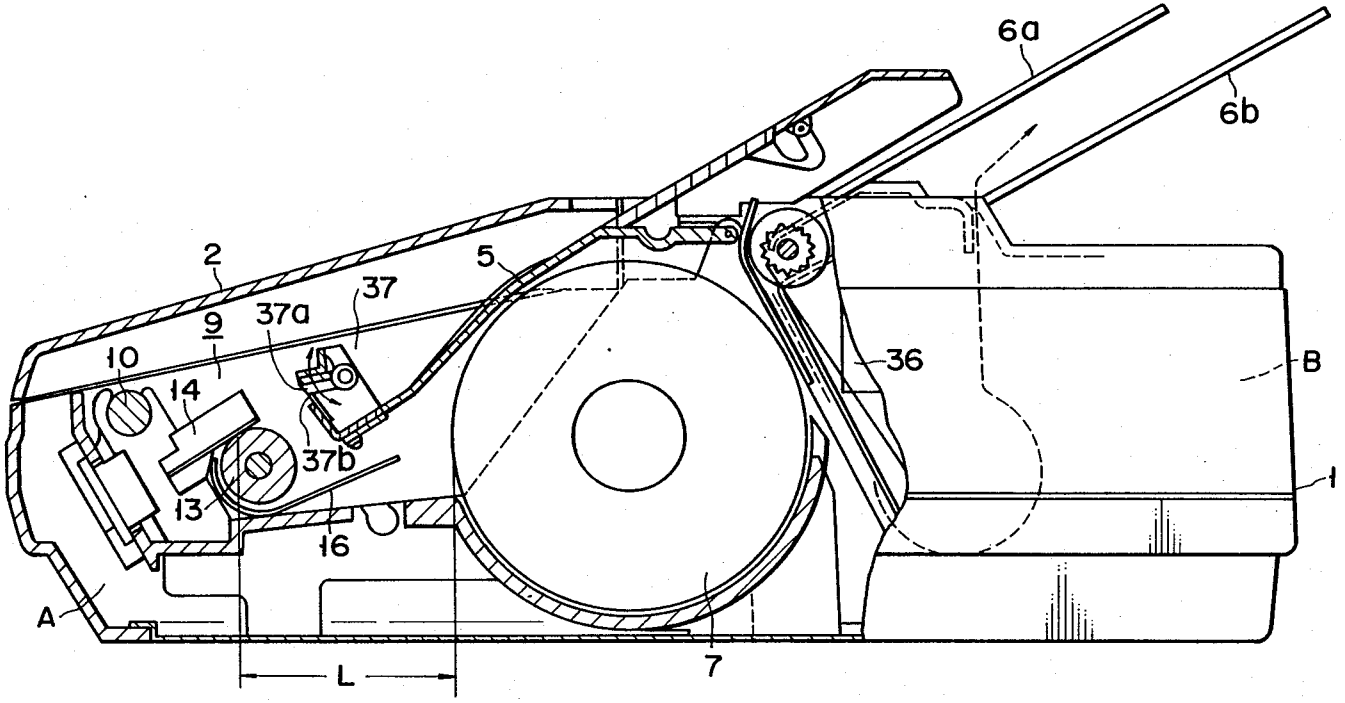

As shown in FIG. 6, holder portion 8 is defined substantially in the center of body case 1. Rolled recording sheet 7 is rotatably stored in portion 8. Sheet 7 in portion 8 is situated below the lower part of sheet tray 5. As shown in FIG. 8, the inside of body case 1 includes holder portion (first holder portion) 8, front space (second holder portion) A in front of portion 8, and rear space (third holder portion) B behind portion 8. Front space A, whose top opening can be closed by means of swing cover 2, contains recording unit 9. Unit 9 is arranged so that its top portion is situated below the top of rolled recording sheet 7. In other words, the height of recording unit 9 is shorter than the maximum diameter of the rolled sheet. Document reader 36 is disposed in rear space B. Its height is also shorter than the maximum diameter of rolled sheet 7, that is, the top surface of reader 36 is situated below the top of the rolled sheet in its full volume. Document reader 36 transports a document (not shown) from one document tray 6a along a U-shaped path, as indicated by the broken-line arrow of FIG. 8, and reads and transmits information on the document in the course of the transportation. Thereafter, the document is discharged onto the other document tray 6b. In the present embodiment, the outline of the recording apparatus is thin and flat, featured by the aforementioned arrangement of recording sheet 7, recording unit 9, and document reader 36, and the slant of swing cover 2. Thus, the height of the recording apparatus depends on the maximum diameter of the roll of sheet 7. Distance L between sheet 7 and a printing region between platen 13 and printing head 14 (mentioned later) is minimized, in order to shorten the overall length of the recording apparatus.

As shown in FIGS. 1 to 4, recording unit 9 comprises support shaft 10, first and second support members 11 and 12 spaced in the longitudinal direction of shaft 10 (or at right angles to the drawing plane), platen 13, printing head 14, head retainer 15, and sheet feed guide 16.

Support shaft 10 is a rocking shaft which, extend between first and second support frames (not shown) inside body case 1, and is rotatably supported, at both ends thereof, on the support frames. Support members 11 and 12 are rockably supported on their corresponding end portions of shaft 10. The support frames, which are arranged inside case 1 along the opposite side walls thereof, are fixed to the case. The frames and case 1 may be formed integrally with one another. Alternatively, shaft 10 may be attached directly to the side walls of case 1 without the use of the frames. Although support members 11 and 12 have the same shape in this preferred embodiment, the present invention is not limited to such an arrangement. Platen 13 is formed of a roller which extends between members 11 and 12. It is rotatably supported by support members 11 and 12 in a manner such that slender platen shafts 13a at the opposite ends of the platen are fitted in their corresponding bearing grooves individually facing members 11 and 12. Printing head 14 is formed of a line thermal head or the like which stretches over both support members 11 and 12. The opposite end portions of head 14 are movably supported by members 11 and 12 so that the printing surface of the head can touch and leave the peripheral surface of platen 13. Positioning guide 17 with a forked portion at its distal end is disposed at each end portion of printing head 14. Each platen shaft 13a is fitted in a slit of the forked portion of its corresponding guide 17. In this arrangement, the respective centers of platen 13 and head 14 can be aligned with each other. Head retainer 15 is attached to support members 11 and 12 so as to cover the back of printing head 14. Also, it is mounted on support shaft 10 so as to be rotatable around and together with shaft 10. Backup spring 15a, formed of a leaf spring, is disposed between the rear surface of retainer 15 and the back of head 14. The spring resiliently supports the printing head. Retaining portion 18, formed of a pin or the like, protrudes substantially horizontally from that end portion of head retainer 15 which is situated on the side of first support member 11. Sheet feed guide 16 is formed of two thin J-shaped plates arranged vertically with a predetermined space between them. Two opposite ends of guide 16 are fixed individually to support members 11 and 12 so as to be rocked together therewith. Guide 16 is composed of a substantially semicircular curved portion and a straight portion continuous therewith. The sheet feed guide is fixed to members 11 and 12 in a manner such that its outlet end or the extreme end of the curved portion is situated close to the point of contact between platen 13 and printing head 14, the curved portion surrounds substantially half the outer peripheral surface of platen 13, and the straight portion extends toward holder portion 8 or rearward. Thus, recording unit 9, as a whole, is mounted on the support frames (body case 1) so as to be rockable around support shaft 10.

Figure 3:
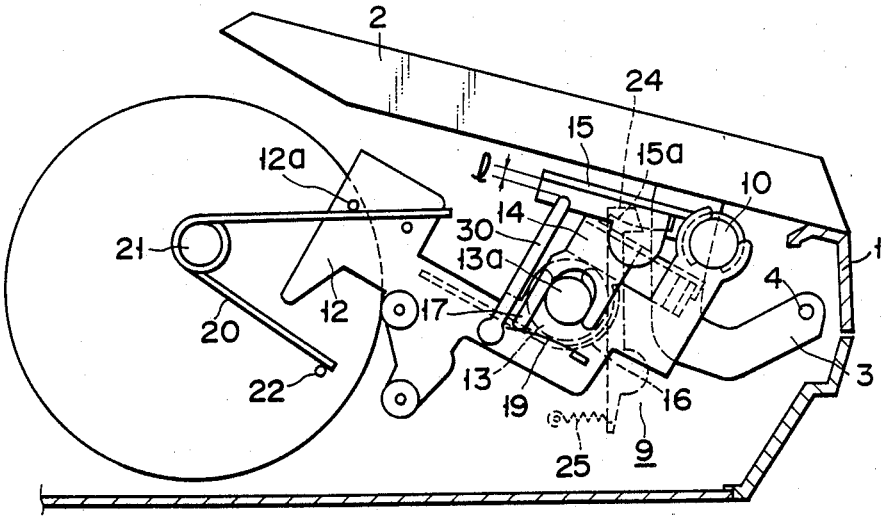
Figure 4:
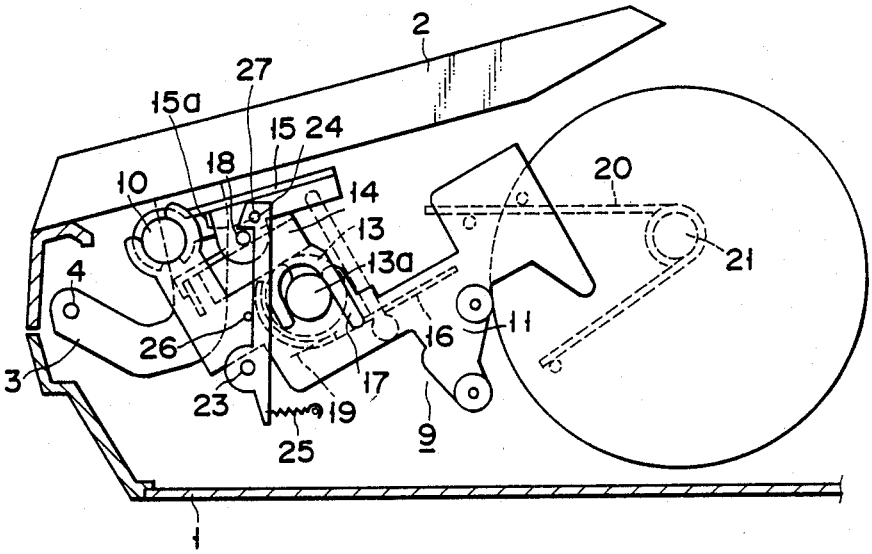

Shift spring 19 is attached to second support member 12 of recording unit 9. One end side of spring 19 is fixed to member 12, while the other end side engages the forked portion of positioning guide 17. Thus, when recording unit 9 is held in position, as shown in FIGS. 3 and 4, spring 19 continually urges printing head 14 to move away from platen 13. The shift spring is adjusted so that its urging force is smaller than that of backup spring 15a.

Recording unit is always urged to rock upward or in the clockwise direction of FIG. 3 by unit urging spring 20. Spring 20 is a torsion spring mounted on the second support frame on the side of second support member 12 so that its middle portion is wound around mounting portion 21, which protrudes from the second frame. The upper end portion of spring 20 is in engagement with spring receiving projection 12a protruding from support member 12, while the lower end portion of the spring engages spring receiving projection 22 protruding from the second support frame. Thus, the unit urging spring serves to urge recording unit 9.

Rod-shaped stopper 30 is fixed to second support member 12 so as to extend toward head retainer 15. It serves to restrain retainer 15 from being unduly depressed. When recording unit 9 is held in position, the distal end of stopper 30 is opposed to the inside of the top portion of retainer 15 at narrow distance 1 (see FIG. 3) therefrom.

Clamp member 24 is rockably mounted, at its lower portion, on the first support frame (not shown) on the side of first support member 11 by means of pivot 23. It is urged to rock in the counterclockwise direction of FIG. 2 by means of tension spring 25, whose opposite ends are coupled individually to the lower end of member 24 and the first support frame. The counterclockwise rocking motion of clamp member 24 is stopped at a predetermined position where member 24 is substantially vertical, by stopper projection 26 which protrudes from the first support frame. A stepped retaining portion formed at the upper portion of clamp member 24 can be engaged with and disengaged from retaining portion 18. When both these retaining portions engage each other, recording unit 9 is held in its recording position. Clamp release portion 27, which is a pin as an urging element, protrudes substantially horizontally from the upper portion of member 24.

In FIG. 8, numeral 37 designates a cutter which is attached to the lower end of sheet tray 5 or recording unit 9. The cutter, which includes movable edge 37a and fixed edge 37b, cuts recording sheet 7 to length as the sheet passes it.

In the recording apparatus constructed in this manner, as shown in FIGS. 3 and 4, recording unit 9 is normally positioned so that the inlet of sheet feed guide 16 is located substantially tail first or faces the rolled recording sheet. This state is maintained by the engagement between retaining portion 18 and clamp member 24, and recording unit 9 is concealed by swing cover 2 in the closed position. In this state, printing head 14 is pressed against platen 13 by means of the resilient force of backup spring 15*a* of head retainer 15. Meanwhile, the distal end portion of positioning guide 17 presses shift spring 19 to bend it, and spring receiving projection 12*a* of support member 12 presses unit urging spring 20 to bend it.

When the aforesaid original position is maintained, the leading end portion of recording sheet 7, previously fed along sheet feed guide 16, is held between platen 13 and printing head 14. If head 14 is actuated in this state, recording on sheet 7 is effected, and platen 13 is rotated by means of a sheet feed drive system (not shown). Thereupon, sheet 7 is fed forward so that its recorded portion is discharged onto the top surface of sheet tray 5.

Recording sheet 7 is set in the following manner.

Release button 28 on the top of body case 1 is depressed to release swing cover 2 from the fixed state, and cover 2 is then manually rocked forward around pivot 4, as indicated by the arrow of FIG. 5. Thereafter, sheet tray 5 is manually turned rearward in a manner such that its front side is raised. Thus, holder portion 8 for recording sheet 7 is exposed.

Subsequently, clamp release portion 27 of clamp member 24 is urged rearwardly by an operator's finger so that member 24 is rocked in the clockwise direction of FIG. 4 around pivot 23, to be disengaged from retaining portion 18. Thus, head retainer 15 is freed, so that whole recording unit 9 is rocked in the counterclockwise direction of FIG. 4 around support shaft 10 by the urging force of unit urging spring 20. As a result, the inlet side of sheet feed guide 16 faces obliquely upward or is opposed to the top opening of the body case.

Figure 2:
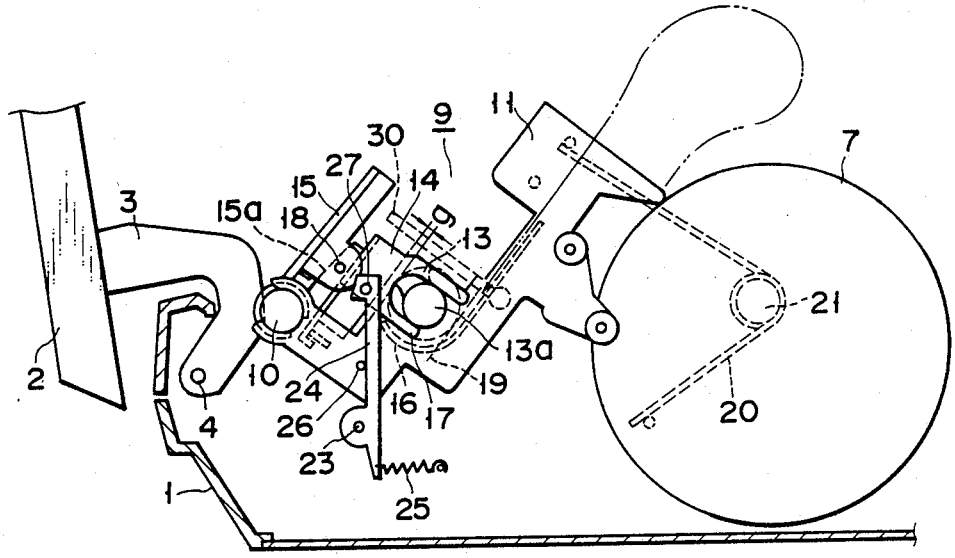

As the whole recording unit rocks upward (or toward the sheet setting position) in this manner, the inlet of sheet feed guide 16 ceases to face holder portion 8, and is directed upward. Thus, the rolled portion of recording sheet 7 is not a hindrance to the insertion of the sheet into the printing region, so that the sheet can be easily inserted. The moment recording unit 9 rocks, printing head 14 is pushed up by the urging force of shift spring 19, through the medium of positioning guide 17. Thereupon, narrow gap g is formed between head 14 and platen 13, as shown in FIGS. 1 and 2.

Thereafter, rolled recording sheet 7 is loaded into holder portion 8 from above, as shown in FIG. 6. Subsequently, the leading end portion of sheet 7 is drawn out and then turned in the shape of a U above holder portion 8, as indicated by two-dot chain line in FIGS. 1 and 2, to be inserted along sheet feed guide 16. In this manner, the sheet is passed through gap g between platen 13 and printing head 14.

The insertion of recording sheet 7 into the printing region can be facilitated by rocking whole recording unit 9 upward so that it assumes a suitable posture for the replacement of the sheet, as well as by forming gap g between platen 13 and printing head 14.

After the sheet setting is finished, recording unit 9 is held in the recording position, as shown in FIGS. 3 and 4, by depressing head retainer 15 thereof. Thus, by depressing retainer 15 by finger to rock it downward around support shaft 10, printing head 14 is first brought into contact with platen 13, against the urging force of shift spring 19, thereby holding recording sheet 7 between them. While maintaining this state, thereafter, the whole recording unit rocks downward or in the clockwise direction of FIG. 2 around shaft 10, against the urging force of unit urging spring 20. As a result, recording unit 9 reaches its original position, and at the same time, retaining portion 18 of head retainer 15 engages clamp member 24, thereby keeping unit 9 in position.

Referring now to FIGS. 9 to 20, a recording apparatus according to another embodiment of the present invention will be described. In the description of this embodiment to follow, like reference numerals are used to designate those members which have substantially the same constructions and functions as their counterparts in the foregoing embodiment. A description of each such member is omitted or simplified herein.

Cam 31 protrudes from the rear surface of swing cover 2. It has cam face 31*a*, on the peripheral surface of its distal end, which is engaged with or disengaged from clamp release portion 27 of clamp member 24 as cover 2 is swung down or up. The engagement or sliding contact between cam face 31*a* and release portion 27 causes clamp member 24 to rock in the direction of the arrow of FIG. 10, thereby disengaging member 24 from retaining portion 18, as cover 2 rocks. Follower portion 32 is formed on the side face of head retainer 15 of recording unit 9, on the free-end side thereof remoter from support shaft 10. The follower portion is composed of a pin which protrudes horizontally from the side face of retainer 15. Interlocking member 33 is rockably mounted on first support member 11 by means of pivot 34. It is formed of a U-shaped lever. One arm portion of member 33 is pivotally supported on member 11 by means of pivot 34, while the other arm portion constitutes interlocking portion 35 which has a slanting end face adapted to releasably engage follower portion 32. Interlocking member 33 is rocked in association with the swing motion of swing cover 2. More specifically, member 33 is urged in the counterclockwise direction of FIG. 10 by means of tension spring 33*a* which is connected, at either end thereof, to member 33 and a support frame. The interlocking member is rocked counterclockwise and clockwise as cover 2 is swung up and down, respectively. The upward or counterclockwise rocking motion of interlocking member 33 is stopped at a predetermined position (shown in FIG. 10) by means of stop pin 33*b* which protrudes from the support frame.

In the recording apparatus of this embodiment, the use of cam 31 and interlocking member 33 allows recording unit 9 to rock automatically in the clockwise direction as swing cover 2 is swung open. Thus, in contrast with the case of the foregoing embodiment, the swinging operation of cover 2 need not be accompanied with manual operation of printing head 14 and clamp member 24. Accordingly, the replacement of recording sheet 7 requires less labor. The following is a description of the operation of this recording apparatus.

Figure 11:
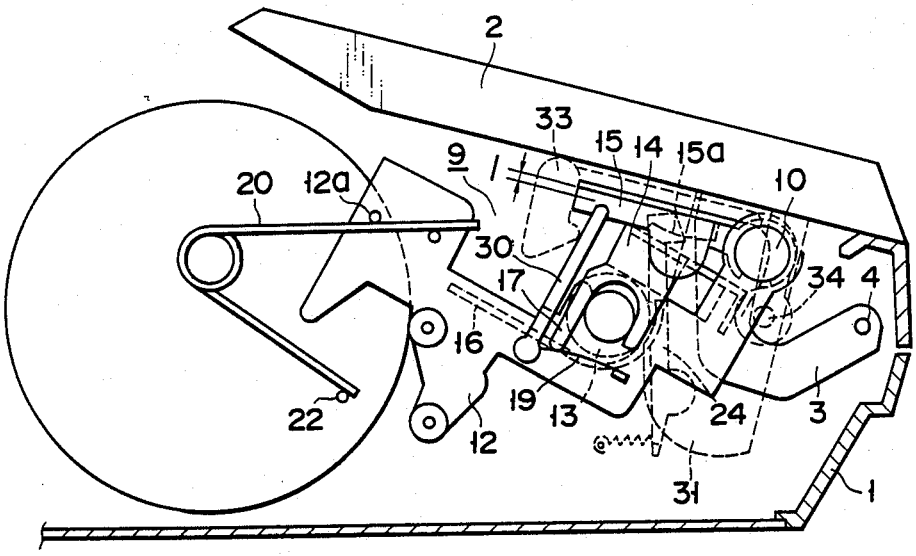
Figure 12:
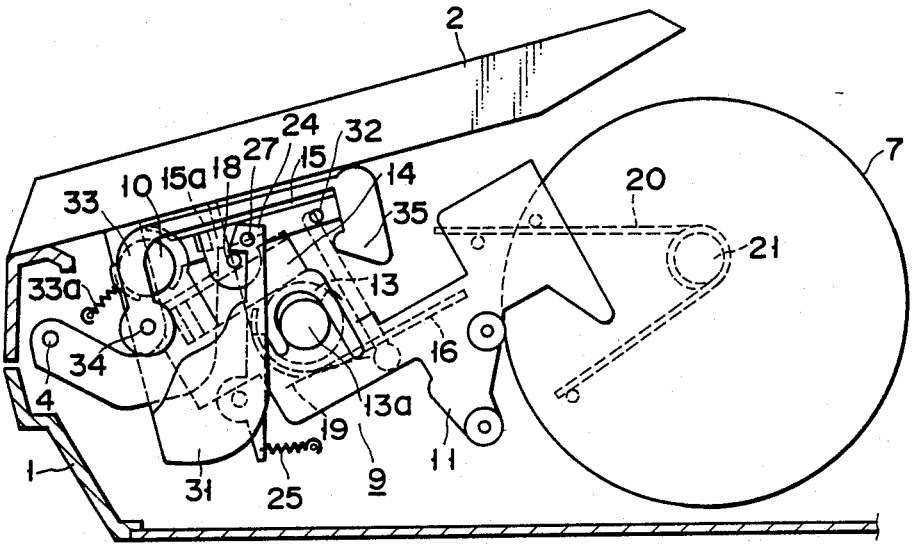
Figure 13:
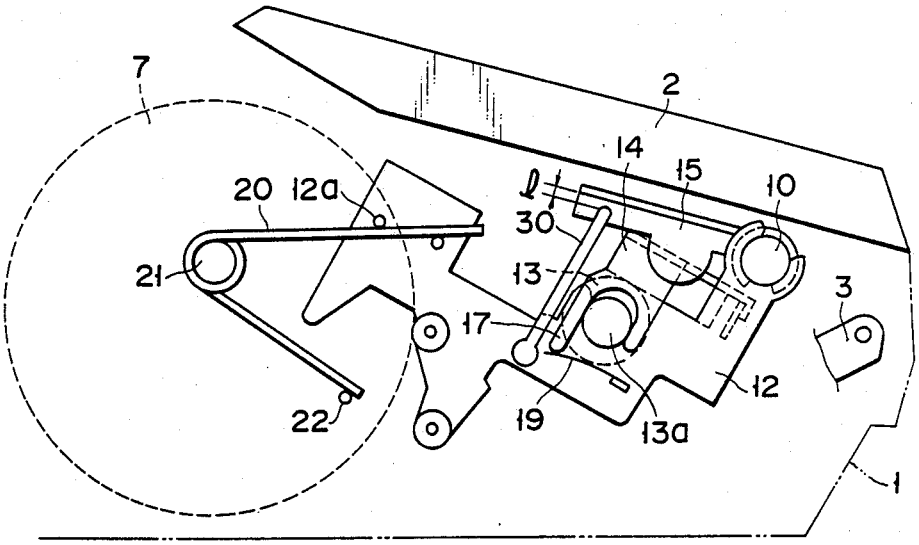
Figure 14:
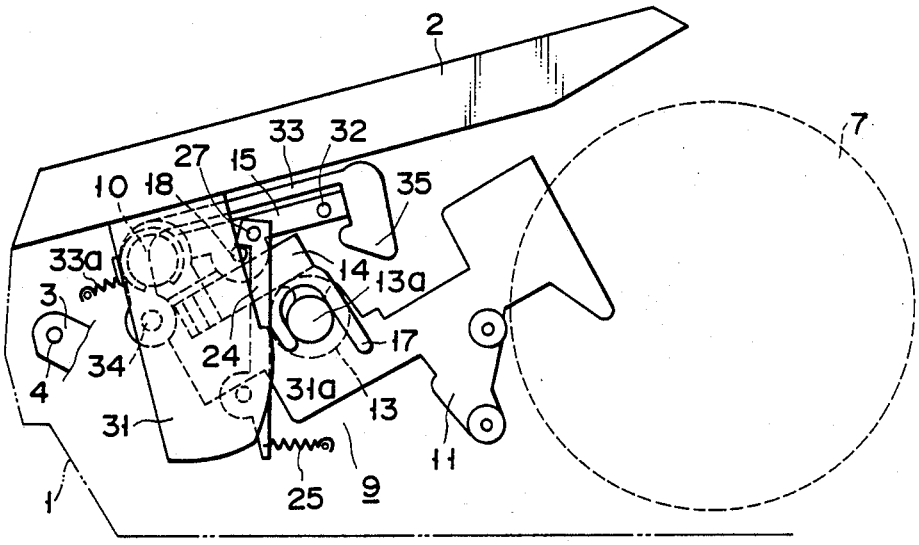
Figure 15:
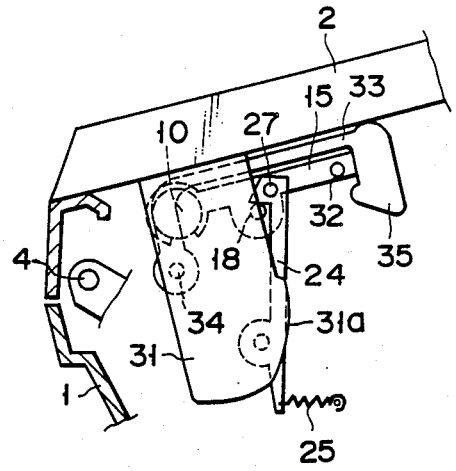

Normally, recording unit 9 is positioned so that the inlet of its sheet feed guide 16 is located substantially tailfirst, as shown in FIGS. 11 and 12. This state is maintained by the engagement between retaining portion 18 and clamp member 24, and recording unit 9 is concealed by swing cover 2. In this state, printing head 14 is pressed against platen 13 by means of the resilient force of backup spring 15*a* of head retainer 5. Meanwhile, the distal end portion of positioning guide 17 presses shift spring 19 to bend it, and spring receiving projection 12*a* of support member 12 presses unit urging spring 20 to bend it. As shown in FIG. 15, moreover, cam face 31*a* of cam 31, protruding from swing cover 2, is disengaged from clamp release portion 27 of clamp member 24 and situated below it. Meanwhile, interlocking portion 35 of interlocking member 33 is disengaged from follower portion 32 of head retainer 15 and situated below the same.

In this state, the leading end portion of recording sheet 7, previously fed along sheet feed guide 16, is held between platen 13 and printing head 14. If head 14 is actuated in this state, recording on sheet 7 is effected, and platen 13 is rotated by means of a sheet feed drive system (not shown). Thereupon, sheet 7 is fed forward so that its recorded portion is discharged onto the top surface of sheet tray 5.

Figure 16:
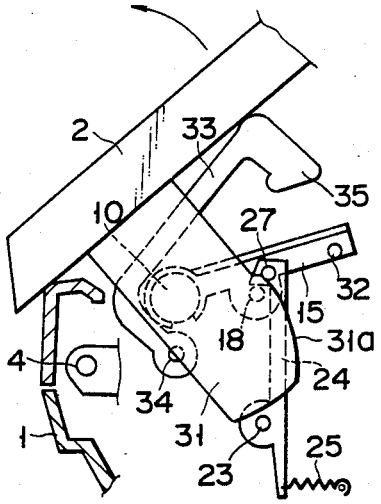

Subsequently, in setting recording sheet 7, swing cover 2 is rocked forward around pivot 4 to open the top of body case 1, in the same manner as described in connection with the first embodiment. Thereafter, sheet tray 5 is turned rearward in a manner such that its front side is raised. Thus, the top of holder portion 8 for recording sheet 7 is exposed. As cover 2 is swung open, interlocking member 33 follows it and rocks in the same direction as the cover, by means of the urging force of spring 33*a*. In this case, recording unit 9 is still kept fixed by clamp member 24, so that interlocking portion 35 of member 33 is shifted above follower portion 32 without engaging it. At the same time, cam face 31*a* of cam 31, protruding from swing cover 2, engages clamp release portion 27 of clamp member 24. This state is shown in FIG. 16.

Figure 9:
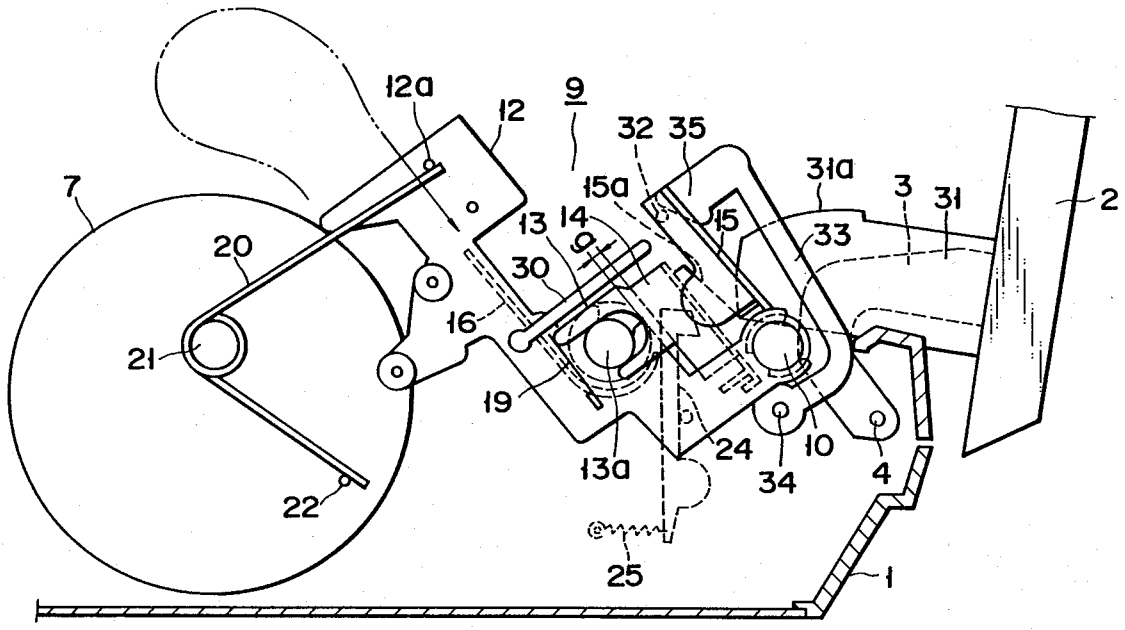
Figure 10:
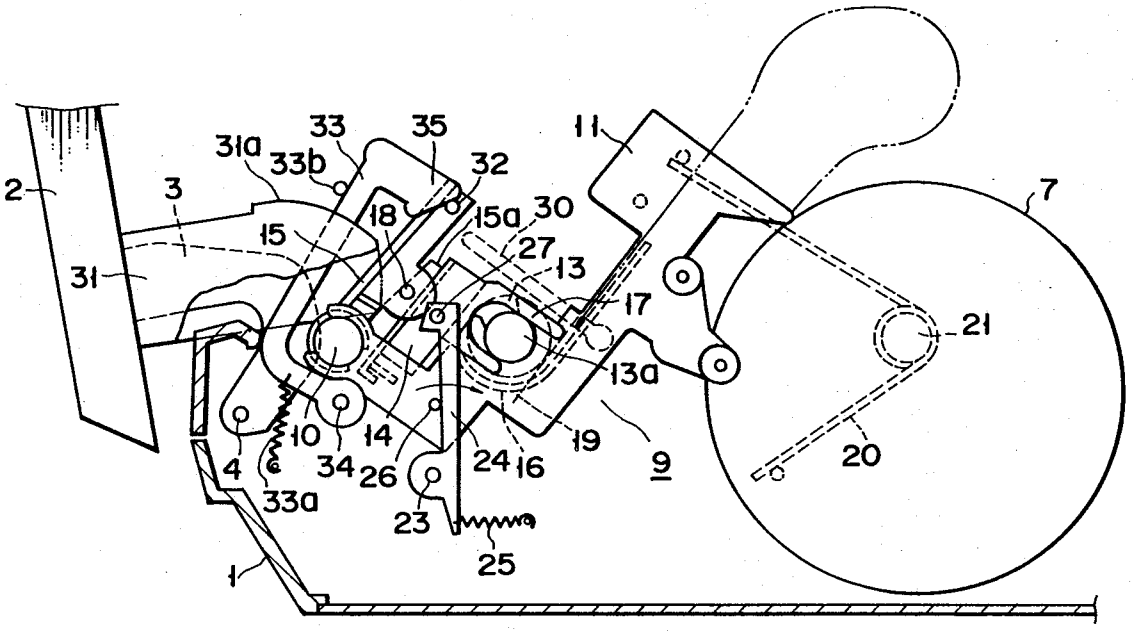
Figure 17:
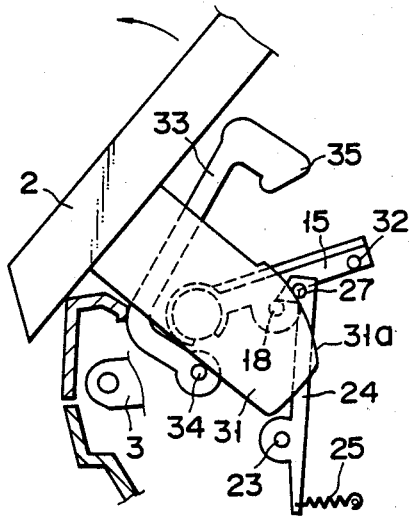

When swing cover 2 further swings in the opening direction, the rising action of interlocking member 33 is restrained by stop pin 33*b*, and cam face 31*a* of cam 31, which is in engagement with clamp release portion 27, causes clamp member 24 to rock in the clockwise direction, as shown in FIG. 17. Thus, member 24 is disengaged from retaining portion 18. As a result, head retainer 15 is freed, so that whole recording unit 9 is rocked counterclockwise around support shaft 10 by the urging force of unit urging spring 20. Thereupon, the inlet side of sheet feed guide 16 faces upward, as shown in FIGS. 9 and 10, and retainer 15 is rocked past clamp member 24 to the region above the same. Thus, swing cover 2 is fully swung open.

Figure 18:
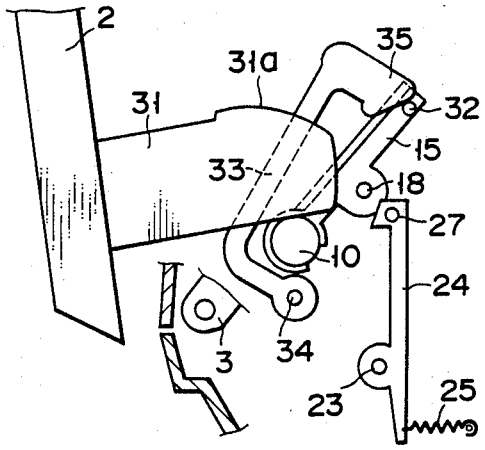

As recording unit 9 rocks upward as aforesaid, head retainer 15 rocks in the counterclockwise direction. However, retainer 15 is positioned as its retaining portion 18 engages interlocking portion 35 of interlocking member 33 previously situated in its stand-by position (FIG. 18).

As the whole recording unit rocks upward in this manner, the inlet of sheet feed guide 16 ceases to face holder portion 8, and is directed upward. Thus, the rolled portion of recording sheet 7 is not a hindrance to the insertion of the sheet into the printing region, so that the sheet can be easily inserted. The moment recording unit 9 rocks upward, printing head 14 is pushed up by the urging force of shift spring 19, through the medium of positioning guide 17. Thereupon, narrow gap g is formed between head 14 and platen 13, as shown in FIGS. 9 and 10.

Thereafter, rolled recording sheet 7 is loaded into holder portion 8 from above. Subsequently, the leading end portion of sheet 7 is drawn out and then turned in the shape of a U above holder portion 8, as indicated by two-dot chain line in FIGS. 9 and 10, to be inserted along sheet feed guide 16. In this manner, the sheet is passed through gap g between platen 13 and printing head 14.

The insertion of recording sheet 7 into the printing region can be facilitated by rocking whole recording unit 9 upward so that it assumes a suitable posture for the replacement of the sheet, as well as by forming gap g between platen 13 and printing head 14.

Figure 19:
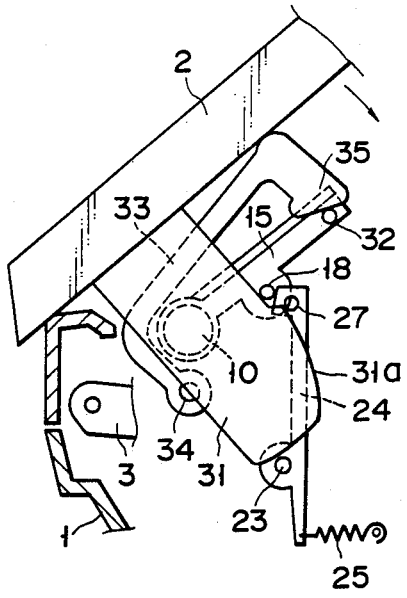
Figure 20:
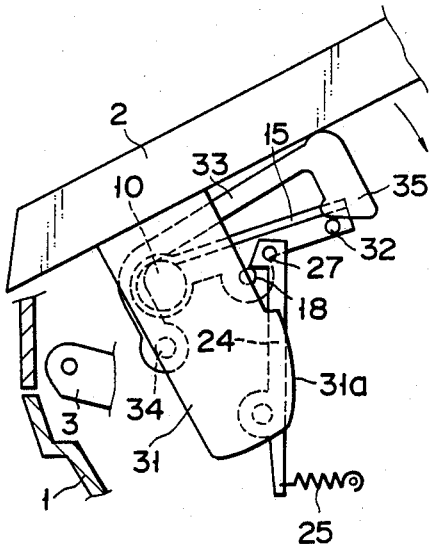

If swing cover 2 is shut down after the end of the insertion of recording sheet 7, recording unit 9 is pushed down to its original position shown in FIGS. 11 and 12. Thus, when cover 2 is downed, cam face 31*a* of cam 31, protruding from the back of the cover, engages clamp release portion 27 of clamp member 24, passes under portion 27 in sliding contact therewith. In this case, clamp member 24, in engagement with cam face 31*a*, is rocked counterclockwise, thereby allowing the passage of the cam face. Immediately before cam face 31*a* passes under clamp release portion 27, interlocking portion 35 of interlocking member 33, being rocked clockwise by the push of swing cover 2, engages follower portion 32 of head retainer 15, as shown in FIG. 19. Thus, as cover 2 is swung down, head retainer 15 is rocked downward around support shaft 10 through the medium of interlocking member 33. Accordingly, printing head 14 is first brought into contact with platen 13, against the urging force of shift spring 19, thereby holding recording sheet 7 between them. While maintaining this state, thereafter, the whole recording unit rocks downward or in the clockwise direction of FIG. 12 around shaft 10, against the urging force of unit urging spring 20. As a result, recording unit 9 reaches its original position, and at the same time, retaining portion 18 of head retainer 15 engages clamp member 24, thereby keeping unit 9 in position. Meanwhile, interlocking portion 35 gets over follower portion 32 to be situated below it, and swing cover 2 is fixed to the closed position. As a result, the state shown in FIGS. 11 and 12 is established.

Thus, when swing cover 2 is in the closed position, interlocking portion 35 is disengaged from follower portion 32, so that the force to fix cover 2 cannot act on head retainer 15 of recording unit 9. The printing pressure of printing head 14 on platen 13 is controlled before cover 2 is mounted. However, if the cover fixing force can be prevented from acting on retainer 15 when cover 2 is on, as described above, the printing pressure never changes when the cover is shut down. In consequence, the printing pressure can be controlled with ease.

Figure 21:
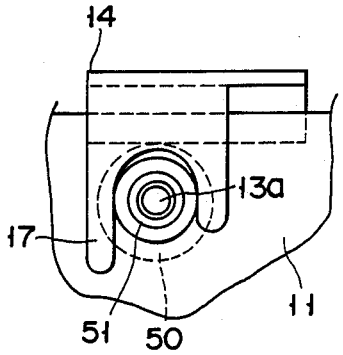
Figure 22:
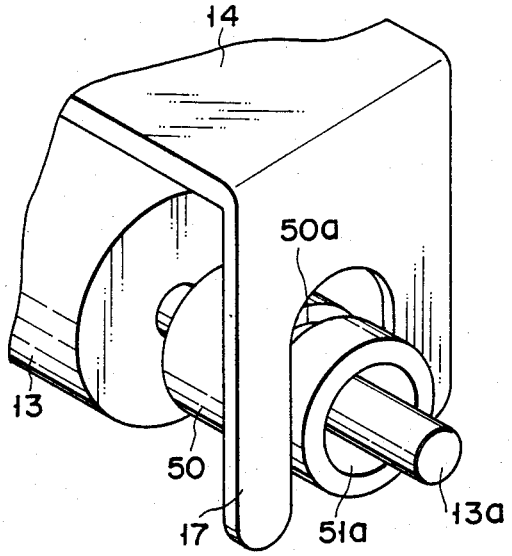
Figure 23:
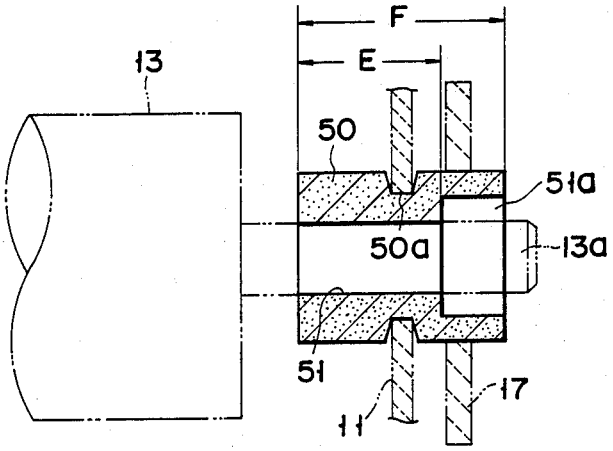

In the embodiments described above, platen shaft 13*a* of platen 13 is rotatably supported by being directly fitted into positioning guide 17 of printing head 14. Alternatively, however, a bearing may be interposed between shaft 13*a* and guide 17. Referring to FIGS. 21 to 23, an example of such an arrangement will be described.

Bearing 50, which is cylindrical in shape, is formed of a synthetic resin with high heat and wear resistance, e.g., polyacetal. Annular groove 50*a* is formed on the substantially central portion of bearing 50. The bearing is fixed to each support member 11 or 12 in a manner such that a groove portion formed on the support member engages groove 50*a*. Platen shaft 13*a* is rotatably inserted in through hole 51 which is formed inside bearing 50. Large-diameter escape groove (escape hole) 51*a* is formed at one end side of hole 51 so that shaft 13*a* is not in contact with bearing 50 at the region corresponding to groove 51*a*. Thus, through hole 51 of bearing 50 has portion E in contact with shaft 13*a* and an uncontacted portion whose length is equal to the difference between overall length F of hole 51 and the length of portion E. By the use of bearing 50 constructed in this manner, platen 13 can be rotatably supported by means of a smaller driving torque and with fewer components. Although the escape groove is provided at the one end side of through hole 51 in this embodiment, it may alternatively be located at the other end side or in the middle of hole 51.

What is claimed is:

1. A recording apparatus comprising:

a body including a first holder portion loaded with a rolled recording sheet, a second holder portion adjacent to the first holder portion, and an opening through which the first and second holder portions are exposed to the outside; and a recording unit disposed in the second holder portion and including support means rockably mounted on the body, a platen rotatably mounted on the support means, and a printing head mounted on the support means for engagement with and disengagement from the platen and printing the recording sheet in cooperation with the platen, sheet feed guide having an outlet situated near a region between the platen and the printing head and an inlet situated on the side of the first holder portion, the sheet feed guide serving to guide the recording sheet in the first holder portion from the inlet toward the outlet, thereby delivering the sheet to the region between the platen and the printing head, said support means supporting the sheet feed guide and being rockable between a recording position, where the inlet of the sheet feed guide faces the recording sheet, and a sheet insertion position, where the inlet of the guide faces the opening of the body;

shift means for disengaging the printing head from the platen when the support means is brought to the sheet insertion position; and a swing cover swingably mounted on the body and movable between a closed position, where at least part of the opening is closed to cover the recording unit, and an open position where the opening is opened to expose the recording unit.

2. The recording apparatus according to claim 1, wherein said support means includes a support member having one and the other ends and mounted on the body for rocking motion between the recording position and the sheet insertion position, and a pivotal mounting member for pivotally mounting the one end of the support member on the body, the inlet of said sheet feed guide being situated on the other end side of the support member.

3. The recording apparatus according to claim 2, further comprising an urging member for urging the support member in the direction of the sheet insertion, and lock means for locking the support member to the recording position, against the urging force of the urging member.

4. The recording apparatus according to claim 3, wherein said lock means includes a clamp member rockably supported on the body and having an engaging portion, an engaging member attached to the support member and adapted to engage the engaging portion of the clamp member when the support member is in the recording position, thereby locking the support member to the recording position, and an urging element for urging the clamp member in a direction such that the engaging portion and the engaging member are disengaged from each other.

5. The recording apparatus according to claim 2, wherein said sheet feed guide includes a straight portion and a curved portion connected to each other, said inlet is formed at one end of the straight portion, and said outlet is formed at one end of the curved portion, said curved portion extending along part of peripheral surface of the platen.

6. The recording apparatus according to claim 1, wherein said shift means includes a positioning guide rotatably supporting the platen and fixed to the printing head, and resilient means for resiliently urging the positioning guide to move in one direction with respect to the platen.

7. The recording apparatus according to claim 6, wherein said platen has a slender platen shaft at each end thereof; said recording unit includes a head retainer rockably supported on the support member, and another resilient means for resiliently urging the printing head in the direction opposite to said one direction, said second resilient means being located between the head retainer and the printing head and having an urging force greater than that of the first resilient means; and said positioning guide includes a guide slit extending in said one direction and having each said corresponding platen shaft fitted therein.

8. The recording apparatus according to claim 7, wherein said shift means includes a cylindrical bearing having a through hole through which the platen shaft is passed and an outer peripheral surface in sliding contact with the guide slit.

9. The recording apparatus according to claim 8, wherein the through hole of said bearing has a first inner peripheral surface portion in sliding contact with the platen shaft and a second inner peripheral surface portion off the platen shaft, said first and second inner peripheral surface portions being arranged side by side in the extending direction of the platen shaft.

10. The recording apparatus according to claim 1, further comprising automatic recording unit drive means adapted to rock the support means toward the sheet insertion position as the swing cover is moved toward the open position, and to rock the support means toward the recording position as the swing cover is moved toward the closed position.

11. The recording apparatus according to claim 10, wherein said automatic drive means includes an urging member for urging the support means in the direction of the sheet insertion, lock means for locking the support means to the recording position, against the urging force of the urging member, and lock drive means adapted to release the support means from the locking by the lock means as the swing cover is moved toward the open position, and to allow the support means to be locked by the lock means as the swing cover is moved toward the closed position.

12. The recording apparatus according to claim 11, wherein said lock drive means includes an urging element for urging the lock means to be released, and a cam provided on the swing cover and adapted to release the lock means against the urging force of an urging means as the swing cover is moved toward the open position, and to allow the lock means to be locked by the urging means as the swing cover is moved toward the closed position.

13. The recording apparatus according to claim 1, wherein said shift means includes printing head drive means adapted to move the printing head away from the platen as the swing cover is moved toward the open position, and to move the printing head toward the platen as the swing cover is moved toward the closed position.

14. The recording apparatus according to claim 13, wherein said printing head drive means includes urging means for resiliently urging the printing head to move away from the platen, and a drive member adapted to be pressed by the swing cover to move the printing head toward the platen, against the urging force of the urging means, when the swing cover is moved toward the closed position.

15. A recording apparatus comprising:

a body including a first holder portion loaded with a rolled recording sheet, a second holder portion adjacent to one side of the first holder portion, a third holder portion adjacent to the other side of the first holder portion, and an opening through which the first and second holder portions are exposed to the outside;

a recording unit disposed in the second holder portion and including support means rockably mounted on the body, a platen rockably mounted on the support means, a printing head mounted on the support means for engagement with and disengagement from the platen and adapted to print the recording sheet in cooperation with the platen, sheet feed guide having an outlet situated substantially between the platen and the printing head and an inlet situated on the side of the first holder portion, said sheet feed guide serving to guide the recording sheet in the first holder portion from the inlet toward the outlet, thereby delivering the sheet to the region between the platen and the printing head, said support means supporting the sheet feed guide and being rockable between a recording position, where the inlet of the sheet feed guide faces the recording sheet, and a sheet insertion position, where the inlet of the guide faces the opening of the body; and shift means for disengaging the printing head from the platen when the support means is brought to the sheet insertion position, the maximum diameter of said rolled recording sheet being longer than the height of the recording unit.

16. The recording apparatus according to claim 15, further comprising a swing cover declining from the first holder portion toward the second holder portion and capable of closing the opening of the body.

17. The recording apparatus according to claim 16, further comprising a reading device disposed in the third holder portion, and sheet transportation means for supplying a document to the reading device and discharging the document to the outside after the reading operation by the reading device.

* * * * *